US008814606B2

(12) United States Patent
Endo et al.

(10) Patent No.: US 8,814,606 B2
(45) Date of Patent: Aug. 26, 2014

(54) ELECTRIC CONNECTOR

(71) Applicant: Dai-Ichi Seiko Co., Ltd., Kyoto (JP)

(72) Inventors: Takayoshi Endo, Shizuoka (JP); Sakai Yagi, Shizuoka (JP); Jun Mukunoki, Shizuoka (JP); Shui Touno, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 13/706,456

(22) Filed: Dec. 6, 2012

(65) Prior Publication Data

US 2013/0149917 A1 Jun. 13, 2013

(30) Foreign Application Priority Data

Dec. 8, 2011 (JP) ..... 2011-269185

(51) Int. Cl.

| | |
|---|---|
| ***H01R 13/405*** | (2006.01) |
| ***H01R 43/00*** | (2006.01) |
| ***H01R 43/18*** | (2006.01) |
| ***H01R 13/52*** | (2006.01) |

(52) U.S. Cl.

CPC ..... *H01R 13/405* (2013.01); *H01R 43/005* (2013.01); *H01R 43/18* (2013.01); *H01R 13/5216* (2013.01); *H01R 13/521* (2013.01); *Y10S 439/93* (2013.01)

USPC ..... 439/736; 439/930

(58) Field of Classification Search

USPC ..... 439/736, 936

See application file for complete search history.

(56) References Cited

U.S. PATENT DOCUMENTS

| | | | | |
|---|---|---|---|---|
| 4,935,454 | A * | 6/1990 | Koblitz et al. | 522/24 |
| 6,149,456 | A * | 11/2000 | Uchiyama | 439/488 |
| 7,445,481 | B2 * | 11/2008 | Nagashima et al. | 439/276 |

FOREIGN PATENT DOCUMENTS

| | | |
|---|---|---|
| JP | 10-284170 | 10/1998 |
| JP | 2009-181798 | 8/2009 |
| JP | 2010-267512 | 11/2010 |

* cited by examiner

*Primary Examiner* — Phuong Dinh

(74) *Attorney, Agent, or Firm* — Wenderoth, Lind & Ponack, L.L.P.

(57) ABSTRACT

The electric connector includes a housing having an opening and a bottom, the housing being formed at the bottom with a recess, at least one electric terminal projecting through a bottom of the recess into the housing, and a seal composed of light-curing resin, the seal at least partially filling the recess therewith for hermetically sealing the electric terminal.

14 Claims, 10 Drawing Sheets

TOTAL AMOUNT OF LIGHT AND REACTION RATE (%)

| | | TOTAL AMOUNT OF LIGHT (mJ/cm²) | | |
|---|---|---|---|---|
| | | 5000 | 10000 | 15000 |
| DEPTH (mm) | 1 | 62 | 92 | 100 |
| | 2 | 50 | 82 | 95 |
| | 3 | 40 | 70 | 90 |

ELECTRIC CONNECTOR

BACKGROUND OF THE INVENTION

1. Field of the Invention

The invention relates to an electric connector including a housing, and an electric terminal projecting through a bottom of the housing into the housing and sealed therearound with light-curing resin.

2. Description of the Related Art

In an electric connector used outdoors or used in a receptacle filled with fluid, holes through which electric terminals are inserted are sealed with resin to thereby close gaps in order to prevent penetration of fluid and/or dust. Such electric connectors have been suggested, for instance, in Japanese Patent Application Publications Nos. H10(1998)-284170, 2009-181798 and 2010-267512.

Japanese Patent Application Publication No. H10(1998)-284170 has suggested a connector including a housing in which connection terminals are housed, and a cover which is able to open and close relative to the housing. Between the housing and cover is filled with ultraviolet-curing resin in the form of gel to thereby make gaps formed among an area in which the connection terminals and electric wires are fixedly connected with each other, the housing, and the cover fluid-tight.

Japanese Patent Application Publication No. 2009-181798 has suggested a connector including a housing having a sealant layer and a height judge in order to hermetically seal a plurality of holes through which contacts are inserted, formed through a bottom of the housing. The sealant layer is composed of a ultraviolet-curing resin, a resin curing at a room temperature, or a resin curing when heated. The height judge is formed at a bottom of the housing for determining an optimal height by which the sealant is filled.

Japanese Patent Application Publication No. 2010-267512 has suggested an optic and electric connector including a receptacle connector, and a plug housing into which the receptacle connector is fit. The plug housing is formed with a first recess in which a photoelectric transfer part which converts optic signals into electric signals and vice versa, and optical parts for transferring optic signals are arranged, and a second recess in which an electric part which processes only electric signals is arranged. After the first recess was sealed with ultraviolet-curing resin, the second recess is sealed with a resin curing when heated.

Hereinbelow is explained a conventional electric connector with reference to FIGS. 1 and 2.

As illustrated in FIGS. 1 and 2, a conventional electric connector 100 includes a box-shaped housing 110 having an opening, and a plurality of electric terminals 120 inserted into a bottom 111 of the housing 110 and projecting into the housing 110 at distal ends 121 thereof. A sealant layer 130 composed of light-curing resin is formed at the bottom 111 of the housing 110 for hermetically sealing the electric terminals 120. Gaps formed between the electric terminals 120 and holes 112 of the housing 110 through which the electric terminals 120 are inserted are filled with the sealant layer 130 for sealing therebetween. While the electric connector 100 is being transferred on a conveyer, light-curing resin is supplied by a dispenser into an inner space 113 of the housing 110, and then, a light is vertically irradiated onto the light-curing resin for curing the same.

However, the conventional electric connector 100 illustrated in FIGS. 1 and 2 is accompanied with a problem that the sealant layer 130 may be peeled off a peripheral edge of the housing 110 at the bottom 111 thereof.

Since a peripheral edge 114 of the bottom 111 of the housing 110 is defined with a flat bottom 115, and an inner wall 116 standing vertically relative to the bottom 115, a portion of the inner space 113 in which the sealant layer 130 is formed has a constant depth. Since the portion of the inner space 113 has a constant depth, and further since light-curing resin is cured in accordance with a total amount of curing-lights irradiated by a curing-light lamp, a period of time necessary for curing the sealant layer 130 in a peripheral area 131 by means of vertically irradiated curing-lights is equal to a period of time necessary for curing the sealant layer 130 in a central area 132.

If a period of time for irradiating a curing-light to the sealant layer 130 were not sufficient for the sealant layer 130 to be cured, the sealant layer 130 could not be sufficiently cured with the result of reduction in an adhesive force between the sealant layer 130 and the housing 110. In such a case, since the sealant layer 130 broadly makes close contact with the bottom 115 in the central area 132, the sealant layer 130 can have a sufficient adhesive force, however, since the sealant layer 130 makes contact with the bottom 115 only in a small area in the peripheral area 131 of the sealant layer 130, the sealant layer 130 may be peeled off a periphery of the bottom 111 of the housing 110 due to radical oscillation and/or temperature fluctuations. If the peeling of the sealant layer 130 from a periphery of the bottom progresses to an area around the electric terminals 120, it is afraid that fluid may penetrate the sealant layer 130. In such a case, it is necessary to reduce a speed at which a conveyer transfers the electric connector 100 with the result of deterioration of a yield, unless it takes a sufficient period of time for curing light-curing resin.

That is, if light-curing resin of which the sealant layer 130 is composed could be cured in a short period of time, it would be possible to accomplish a high yield, and if the sealant layer 130 could be prevented from peeling off the housing 110, it would be possible to have high reliability.

SUMMARY OF THE INVENTION

In view of the above-mentioned problems in the conventional electric connector, it is an object of the present invention to provide an electric connector which is capable of curing light-curing resin defining a sealant layer, in a short period of time to thereby prevent the sealant layer from peeling off a housing, ensuring a high yield and high reliability.

It is further an object of the present invention to provide a housing suitable for the above-mentioned electric connector.

In one aspect of the present invention, there is provided an electric connector including a housing having an opening and a bottom, the housing being formed at the bottom with a recess, at least one electric terminal projecting through a bottom of the recess into the housing, and a seal composed of light-curing resin, the seal at least partially filling the recess therewith for hermetically sealing the electric terminal.

Since the electric connector in accordance with the present invention is designed to include the housing having the recess which is capable of reducing a thickness of the seal in a peripheral area of a bottom of the housing, it is possible to allow a light irradiated for curing light-curing resin to reach a peripheral area of the recess. Consequently, even if a curing-light were irradiated to the seal in a short period of time, it would be possible to sufficiently cure the seal with the result that it is possible to prevent the seal from peeling off the housing.

It is preferable that the recess has an inclining sidewall.

By designing the recess to have an inclining sidewall, the recess can have a reduced depth within the inclining sidewall, and hence, it is possible to allow a curing-light to surely reach a bottom within the inclining sidewall.

It is preferable that the inclining sidewall has a flat surface, in which case, the recess has a gradually varying depth.

It is preferable that at least a part of a surface of the recess is a projecting curved surface.

By designing the recess to have a projecting curved surface, it is possible for the recess to have a further reduced depth, and it is further possible to increase an area in which the seal makes contact with the recess, relative to a case in which the recess has a flat inclining sidewall, with the result of enhancement in an adhesive force acting between the seal and the recess.

It is preferable that the projecting curved surface has such a shape that a vertically irradiated light beam does not make shade therebelow.

At least a part of the inclining sidewall may be designed to be continuously raised and recessed, in which case, it is possible to further increase the above-mentioned contact area with the result of further enhancement in an adhesive force acting between the seal and the recess. For instance, at least a part of a surface of the recess may be step-shaped.

It is preferable that each of steps has an inclining sidewall.

It is preferable that the recess has an area smaller than an area of the bottom of the housing when viewed vertically.

By so designing the recess, there exists an area between a peripheral edge of the recess and a sidewall of the housing, ensuring it possible to reduce an influence exerted by shade of a curing-light caused by an upper portion of the sidewall of the housing.

In another aspect of the present invention, there is provided a housing defining a part of an electric connector, the housing having an opening and a bottom and being formed at the bottom with a recess, the recess being formed at a bottom thereof with at least one hole through which an electric terminal is inserted such that the electric terminal projects into the housing, the recess being to be at least partially filled with light-curing resin for hermetically sealing the electric terminal.

The present invention provides the advantages set forth hereinbelow.

Since the electric connector in accordance with the present invention is designed to include the housing having the recess which is capable of reducing a thickness of the seal in a peripheral area of a bottom of the housing, it is possible to allow a light irradiated for curing light-curing resin to reach a peripheral area of the recess. Consequently, even if a curing-light were irradiated to the seal in a short period of time, it would be possible to sufficiently cure the seal with the result that it is possible to prevent the seal from peeling off the housing, and to ensure a high yield and high reliability.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings. In the specification, "upper" indicates a side of the housing in which an opening exists, and "lower" indicates a side of the housing in which a bottom exists.

First Embodiment

Figure 1:
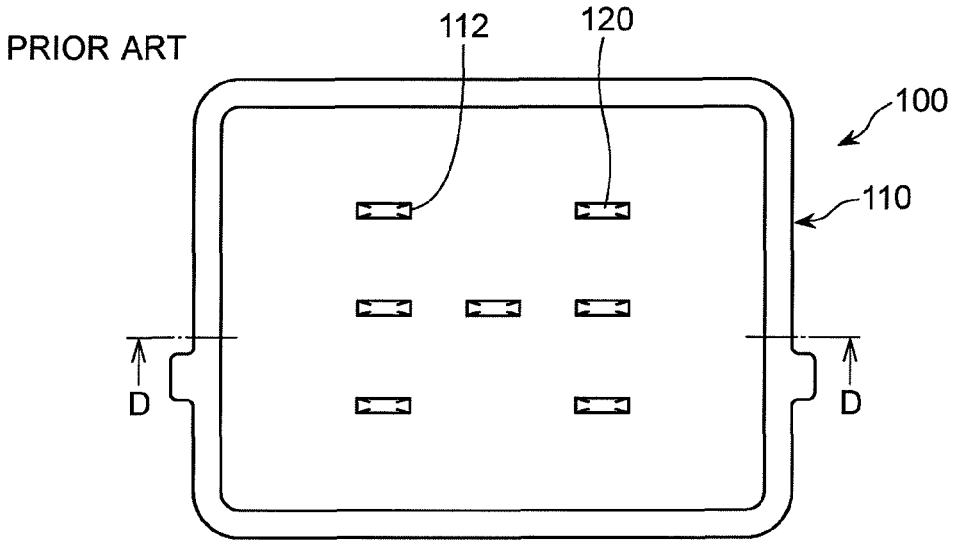
FIG. 1 is a plan view of the conventional electric connector.
Figure 2:
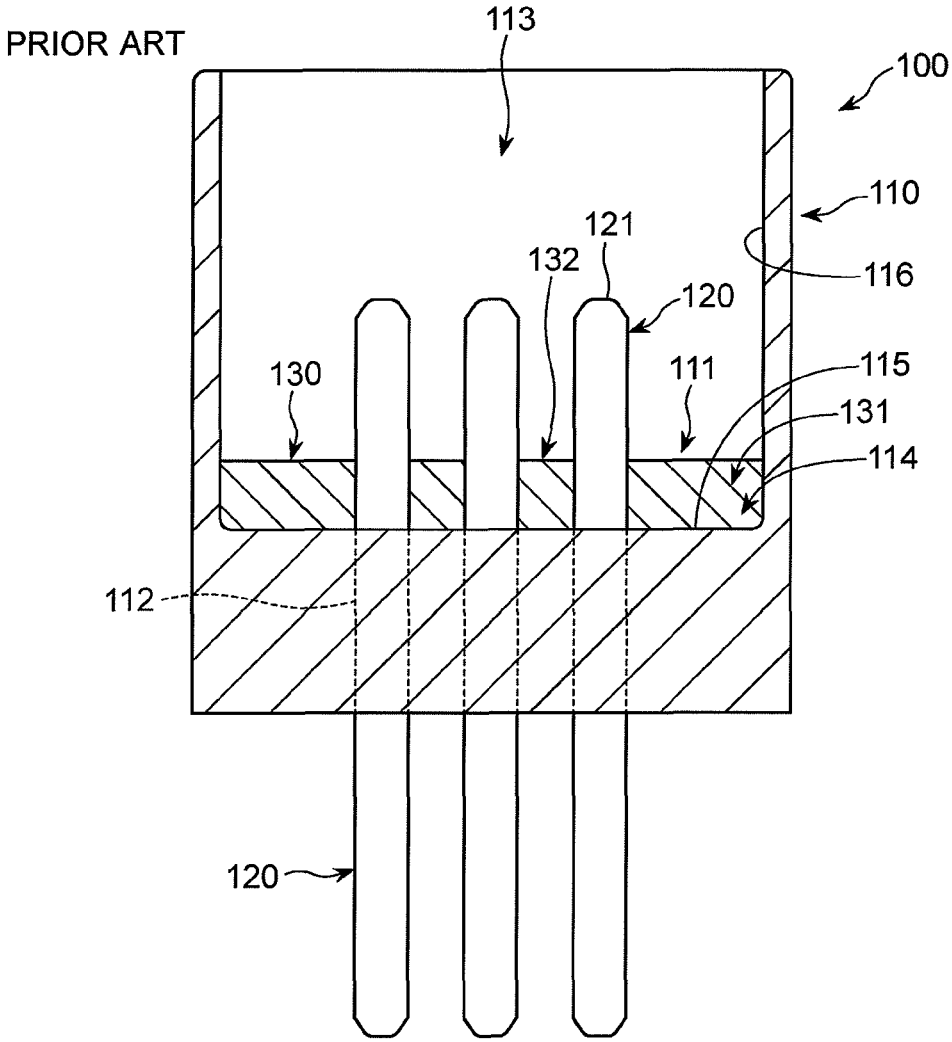
FIG. 2 is a cross-sectional view taken along the line D-D in FIG. 1.
Figure 3:
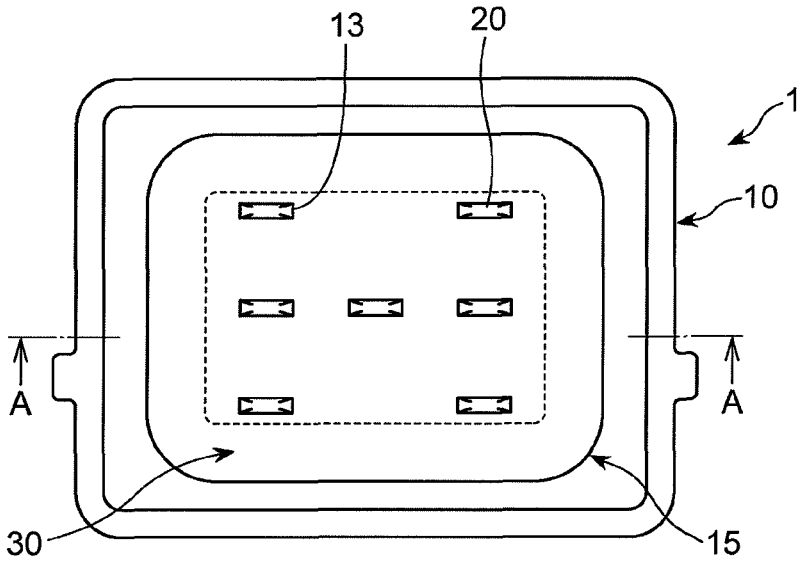
FIG. 3 is a plan view of the electric connector in accordance with the first embodiment of the present invention.
Figure 4:
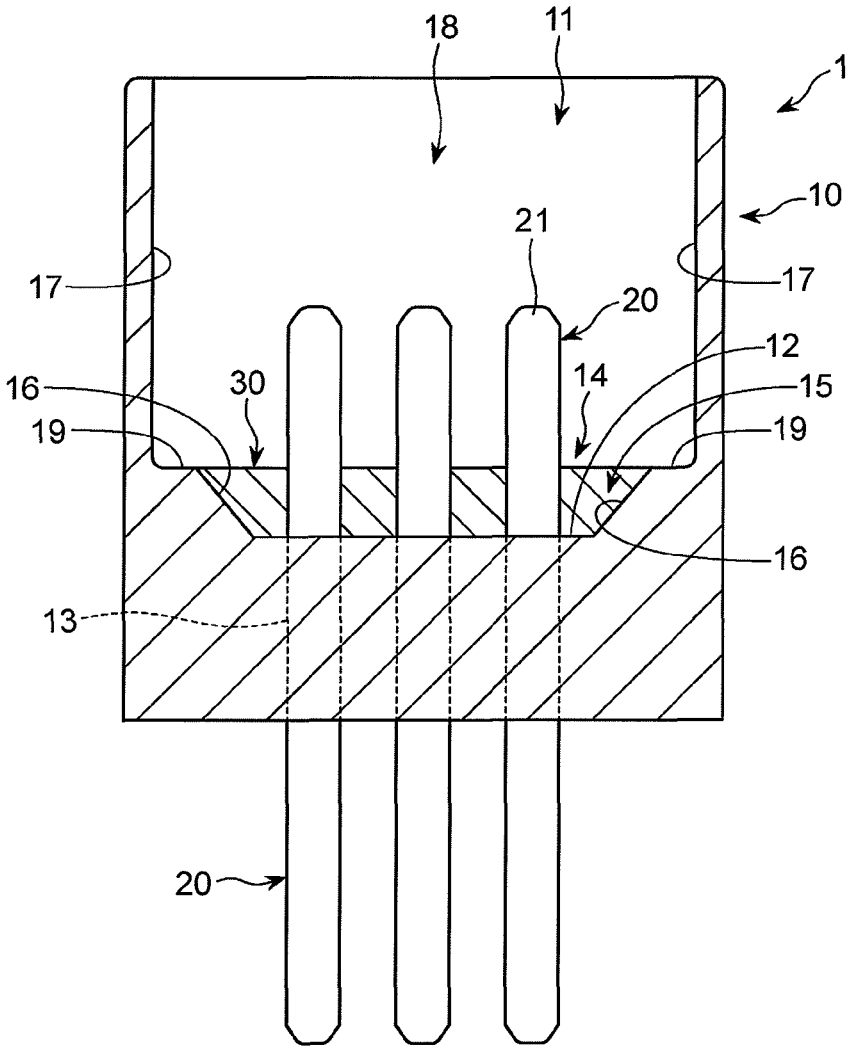
FIG. 4 is a cross-sectional view taken along the line A-A in FIG. 3.

An electric connector 1 in accordance with the first embodiment, illustrated in FIGS. 3 and 4, is used in an electric circuit equipped in an automobile, for instance.

The electric connector 1 includes a housing 10, a plurality of electric terminals 20, and a sealant layer 30.

The housing 10 has a substantially rectangular bottom 14, and a sidewall 17 vertically standing at a periphery of the bottom 14. An upper edge of the sidewall 17 defines an opening 11.

The housing 10 is formed at the bottom 19 with a recess 15. The recess 15 has an inclining sidewall 16, and hence, the recess 15 has a reverse-trapezoidal cross-section. The inclining sidewall 16 has a flat surface, and defines a depth gradually reducing towards the sidewall 17 of the housing 10 from a bottom 12 of the recess 15.

The recess 15 has a smaller area than an area of the bottom 14 of the housing 10 when viewed vertically, as illustrated in FIG. 3. Accordingly, the bottom 14 of the housing 10 can be seen as a shelf 19 only between a peripheral edge of the recess 15 and the sidewall 17 of the housing 10.

The recess 15 is formed at the bottom 12 thereof with a plurality of holes 13 through which the electric terminals 20 are inserted. Each of the holes 13 has an elongated rectangular cross-section in line with a horizontal cross-section of the electric terminal 20.

The electric terminal 20 is composed of thin metal plates in the form of a bar. Each of the electric terminals 20 is inserted into the hole 13 such that a distal end 21 thereof projects into an inner space 18 of the housing 10.

The sealant layer 30 is composed of light-curing resin filled in the recess 15. The sealant layer 30 seals the electric terminals 20 from surroundings. The sealant layer 30 in the first embodiment is designed to have a thickness (depth) from the bottom 12 of the recess 15 to an upper edge of the inclining sidewall 16. It should be noted that the sealant layer 30 may be designed to have a thickness smaller than a height of the inclining sidewall 16, if the sealant layer 30 can sufficiently seal the electric terminals 20 from the surroundings, and a sufficient adhesive force can be given between the sealant layer 30 and the housing 10.

In the first embodiment, the sealant layer 30 is designed to have a thickness of about 3 mm at a center thereof.

As the light-curing resin, there may be used a resin which can be cured by a curing-light, for instance, an invisible light such as a ultraviolet ray and an infra-red ray, or a visible light.

Hereinbelow is explained how the light-curing resin in the sealant layer 30 in the electric connector 1 in accordance with the first embodiment is cured, with reference to FIGS. 5 and 6.

Figure 5:
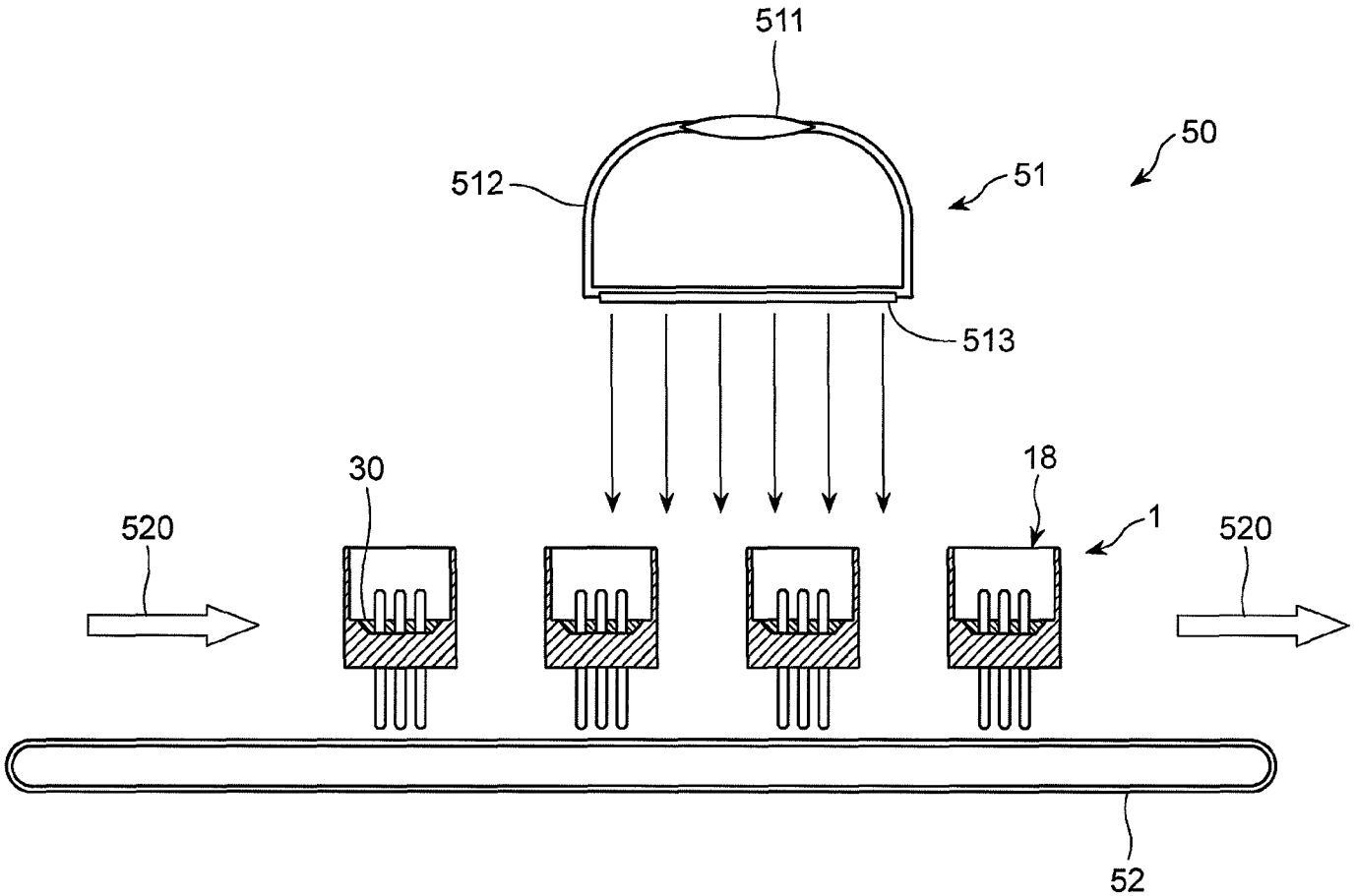
FIG. 5 is a schematic view of an apparatus for curing a sealant layer in the electric connector illustrated in FIG. 3.

The light-curing resin of which the sealant layer 30 is composed is filled in the recess 15 by means of a dispenser (not illustrated), and then, is cured by means of an apparatus 50 for irradiating curing-lights, illustrated in FIG. 5.

The apparatus 50 for irradiating curing-lights includes a curing-light irradiater 51 for irradiating curing-lights, a height adjuster (not illustrated) for adjusting a height of the curing-light irradiater 51, and a conveyer 52 for transferring the electric connectors 1.

The curing-light irradiater 51 includes a lamp 511 irradiating curing-lights, a reflector 512 reflecting the curing-lights irradiated from the lamp 511, towards each of the electric connectors 1, and a cut filter 513 shutting out lights except the curing-lights.

The lamp 511 may be comprised of a metal halide lamp or a high pressure mercury lamp.

The curing-lights irradiated from the lamp 511 through the cut filter 513 are directed to the electric connectors 1 transferred in a direction 520 from an end of the conveyer 52 towards the other end of the conveyer 52. The light-curing resin filled in the recess 15 in the housing 10 is cured by the curing-lights.

Hereinbelow is explained a relation between a reaction rate of the light-curing resin in dependence on a total amount of a curing-light irradiated thereto, and a depth of the light-curing resin, with reference to FIG. 6.

Figures 6, 7:
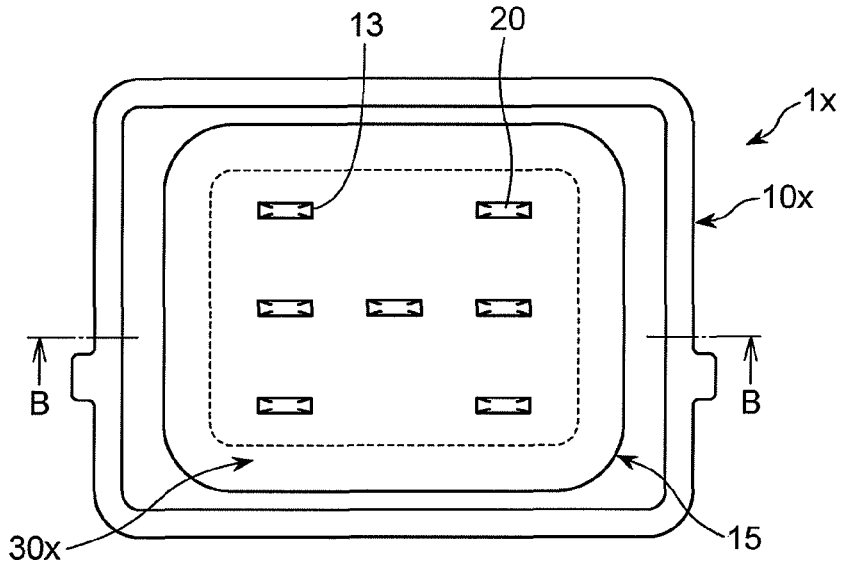
FIG. 6 is a table showing a relation between a reaction rate of light-curing resin in dependence on a total amount of a light irradiated thereto, and a depth of the light-curing resin.
FIG. 7 is a plan view of the electric connector in accordance with the second embodiment of the present invention.

The table shown in FIG. 6 indicates the reaction taken by the three light-curing resins each having a thickness of 1 mm, 2 mm and 3 mm when cured by curing-lights irradiated from a high pressure mercury lamp. The reaction was measured by a Fourier transform infrared spectrophotometer (FTIS).

As shown in FIG. 6, there was obtained a reaction rate of 100% to a depth of 1 mm when a total amount of curing-lights was 15,000 mJ/cm$^2$. Similarly, there were obtained reaction rates of 95% and 90% to depths of 2 mm and 3 mm, respectively, when a total amount of curing-lights was 15,000 mJ/cm$^2$.

When a total amount of curing-lights was 10,000 mJ/cm$^2$, there were obtained reaction rates of 92%, 82% and 70% to depths of 1 mm, 2 mm and 3 mm, respectively.

When a total amount of curing-lights was 5,000 mJ/cm$^2$, there were obtained reaction rates of 62%, 50% and 40% to depths of 1 mm, 2 mm and 3 mm, respectively.

In light of the above-mentioned measurement results, it is understood that light-curing resin having a smaller depth can be cured in a shorter period of time on the assumption that the same total amount of curing-lights is irradiated to light-curing resins.

Since the inclining sidewall 16 of the recess 15 upwardly inclines towards the sidewall 17 of the housing 10 from a center of the recess 15, a curing-light can reach the recess 15 by a shorter distance at a location closer to a peripheral edge of the recess 15. Accordingly, since light-curing resin of which the sealant layer 30 is composed can be cured more surely at a location closer to a peripheral edge of the recess, it is possible to enhance an adhesive force acting between the sealant layer 30 and the recess 15.

Since it is possible to surely cure the sealant layer 30 even in a peripheral area thereof, as mentioned above, it is possible to prevent the sealant layer 30 from peeling off the recess 15, even if curing-lights are irradiated to the light-curing resin in a short period of time. Thus, the electric connector 1 in accordance with the first embodiment provides a high yield and high reliability.

The sidewall 17 of the housing 10 sometimes inwardly inclines at an upper portion thereof due to a tolerance of the housing 10 and/or contraction of the housing 10 found after the housing 10 was formed. However, since the housing 10 is designed to include the shelf 19 extending between the inclining sidewall 16 and the sidewall 17 outwardly from an upper edge of the inclining sidewall 16, even if the sidewall 17 inclines inwardly at an upper portion thereof, the shelf 19 provides a distance between the sidewall 17 and the sealant layer 30, ensuring it possible to suppress an influence exerted by shade of curing-lights caused by an upper portion of the sidewall 17 when the lamp 511 irradiates curing-lights.

Second Embodiment

The electric connector 1X in accordance with the second embodiment is explained hereinbelow with reference to FIGS. 7 and 8. Parts or elements that correspond to those of the electric connector 1 illustrated in FIGS. 3 and 4 have been provided with the same reference numerals, and will not be explained.

Figure 8:
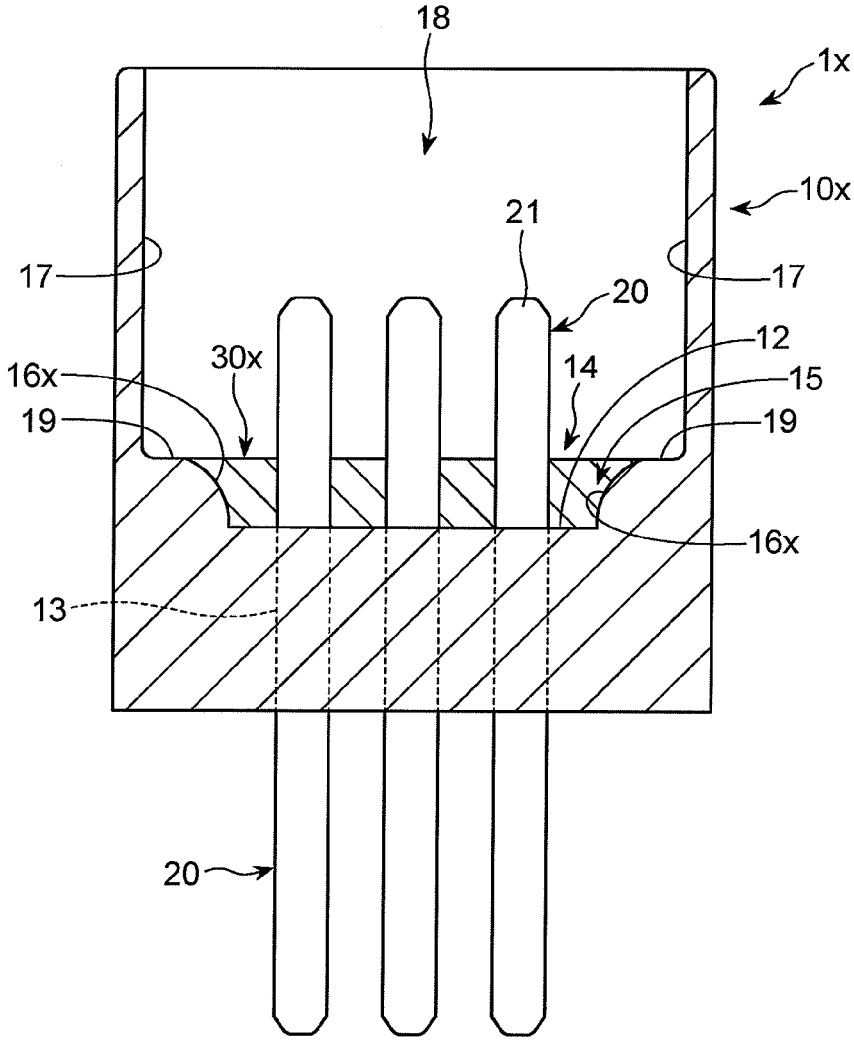
FIG. 8 is a cross-sectional view taken along the line B-B in FIG. 7.

In the electric connector 1X in accordance with the second embodiment, as illustrated in FIGS. 7 and 8, the recess 15 is designed to have an inclining sidewall 16*x* having a projecting curved surface. The projecting curved surface has such a shape that a vertically irradiated light does not make shade therebelow. The sealant layer 30X filled in the recess 15 including the inclining sidewall 16*x* having a projecting curved surface is composed of the same light-curing resin as the light-curing resin of which the sealant layer 30 illustrated in FIGS. 3 and 4 is composed. The sealant layer 30X is designed to have a thickness (a depth) starting from the bottom 12 of the recess 15 and terminating at an upper edge of the inclining sidewall 16*x*.

Even if the inclining sidewall 16*x* is designed to have a projecting curved surface, the recess 15 can have a reduced depth above the inclining sidewall 16*x* with the result that light-curing resin can be surely cured above the inclining sidewall 16*x*, that is, at a peripheral area of the recess 15.

Furthermore, since the inclining sidewall 16*x* can be designed to have a smaller depth than a depth defined by the inclining sidewall 16 having a flat surface, illustrated in FIG. 4, the recess 15 including the inclining sidewall 16*x* can have a greater contact area with the sealant layer 30X, and hence, can have a greater adhesive force with the sealant layer 30X than the recess 15 including the flat inclining sidewall 16 illustrated in FIG. 4.

In addition, the sealant layer 30X can have a reduced volume because the inclining sidewall 16*x* projects inwardly of the recess 15, and accordingly, it is possible to reduce a volume of light-curing resin to be filled in the recess 15.

The inclining sidewall 16*x* illustrated in FIG. 8 is designed to have a projecting curved surface extending entirely over the inclining sidewall 16*x*. It should be noted that a projecting curved surface may be formed over a part of the inclining sidewall 16*x*, in which case, the remainder of the inclining sidewall 16*x* remains flat.

Third Embodiment

The electric connector 1Y in accordance with the third embodiment is explained hereinbelow with reference to FIGS. 9 and 10. Parts or elements that correspond to those of the electric connector 1 illustrated in FIGS. 3 and 4 have been provided with the same reference numerals, and will not be explained.

Figure 9:
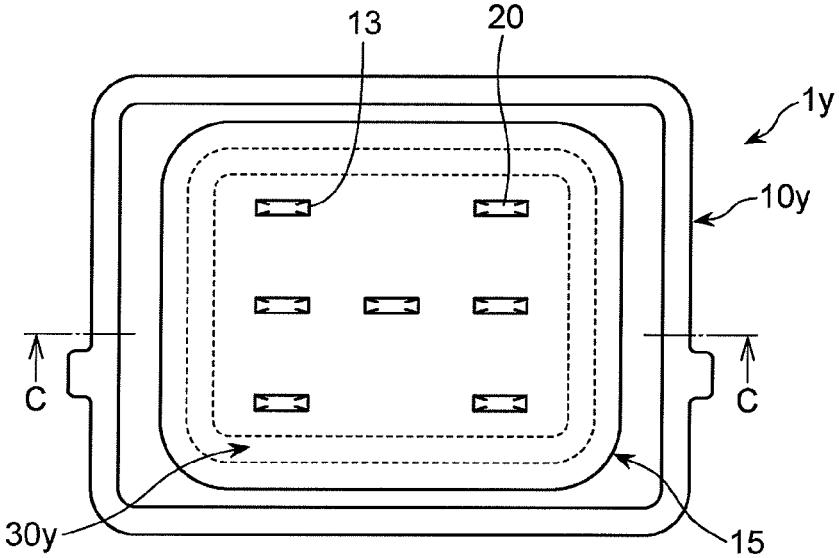
FIG. 9 is a plan view of the electric connector in accordance with the third embodiment of the present invention.
Figure 10:
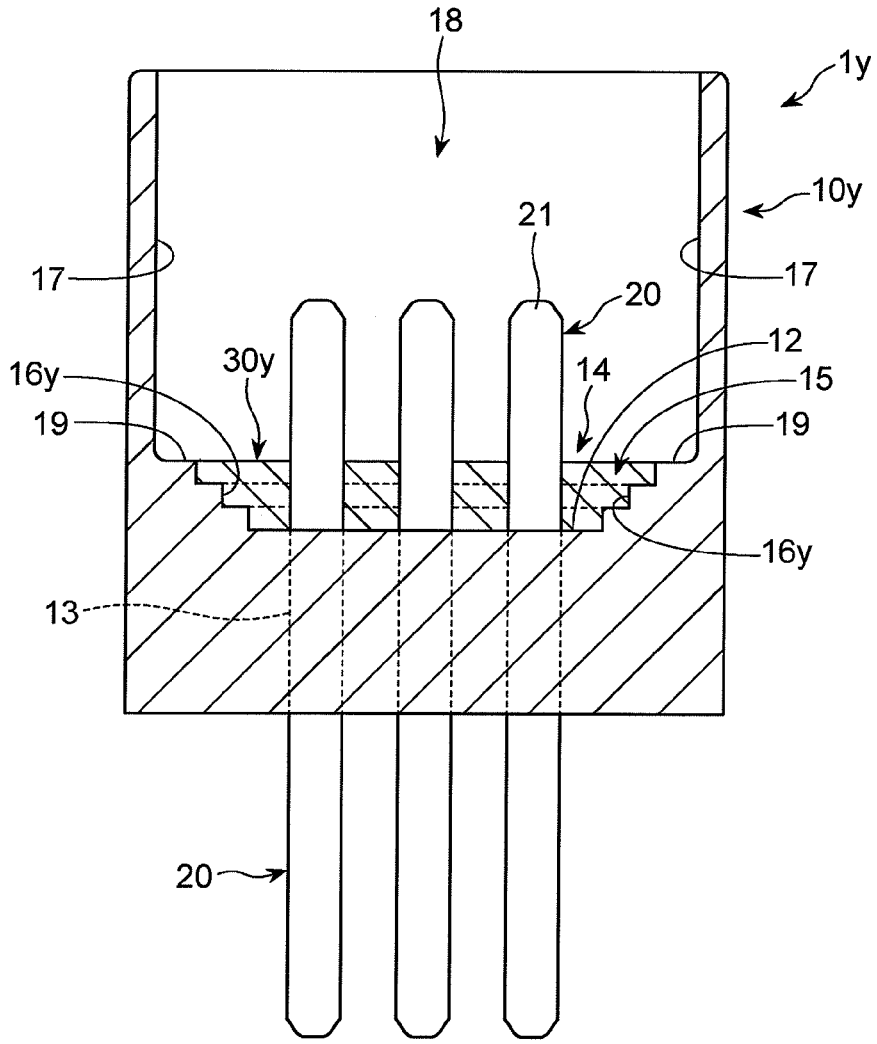
FIG. 10 is a cross-sectional view taken along the line C-C in FIG. 9.

In the electric connector 1Y in accordance with the third embodiment, as illustrated in FIGS. 9 and 10, the recess 15 is designed to have an entirely step-shaped inclining sidewall 16*y*. The sealant layer 30Y filled in the recess 15 including the inclining entirely step-shaped sidewall 16*x* is composed of the same light-curing resin as the light-curing resin of which the sealant layer 30 illustrated in FIGS. 3 and 4 is composed. The sealant layer 30Y is designed to have a thickness (a depth) starting from the bottom 12 of the recess 15 and terminating at an upper edge of the inclining sidewall 16*y*.

The inclining sidewall 16*y* in the third embodiment is designed to have three steps, but may be designed to have one, two, four or more steps in accordance with a frame by which the housing 10*y* is formed.

Even if the inclining sidewall 16*y* is designed to be step-shaped, the recess 15 can have a reduced depth above the inclining sidewall 16*y* with the result that light-curing resin can be surely cured above the inclining sidewall 16*y*, that is, at a peripheral area of the recess 15.

Furthermore, since the inclining sidewall 16*y* can be designed to have a smaller depth than a depth defined by the inclining sidewall 16 having a flat surface, illustrated in FIG. 4, the recess 15 including the inclining sidewall 16*y* can have a greater contact area with the sealant layer 30X, and hence, can have a greater adhesive force with the sealant layer 30X than both the recess 15 including the flat inclining sidewall 16 illustrated in FIG. 4 and the recess 15 having the inclining sidewall 16*x* illustrated in FIG. 8.

Figure 11:
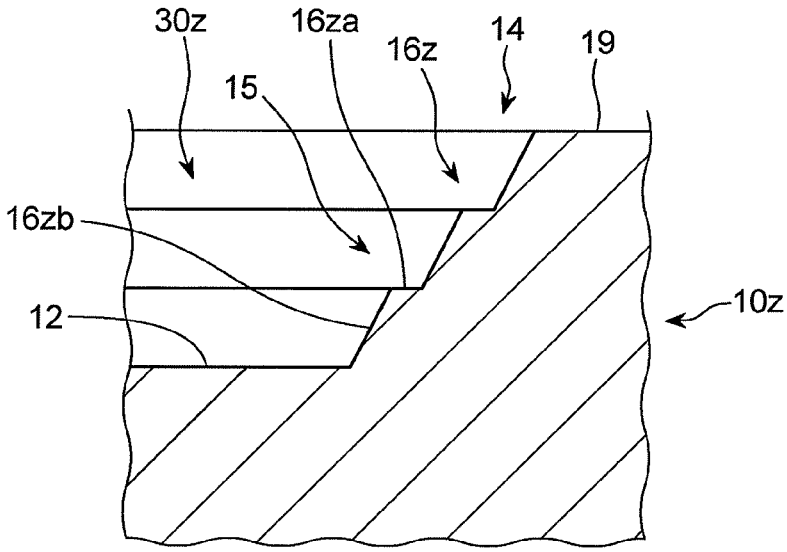
FIG. 11 is a partially enlarged view of the electric connector in accordance with a variant of the third embodiment.

FIG. 11 illustrates a variant of the third embodiment. Though FIG. 11 illustrates only an inclining sidewall 16*z* in an enlarged scale, the remainder is not illustrated because the remainder is identical with FIG. 10.

The inclining sidewall 16*z* illustrated in FIG. 11 is designed to comprise a horizontally extending floor 16*za* and a sidewall 16*zb* standing from the floor 16*za*. The floor 16*za* and the sidewall 16*zb* form an obtuse angle, and hence, the sidewall 16*zb* defines a downwardly inclining surface when viewed from an upper edge of the recess 15.

The inclining sidewall 16*y* illustrated in FIG. 10 is designed to have a sidewall vertically standing from a horizontal floor. In contrast, the inclining sidewall 16*z* includes the downwardly inclining sidewalls 16*zb*, and hence, it is possible to ensure a sufficient adhesive force between the sealant layer 30Z and the recess 15, and further, to prevent generation of a shade caused by curing-lights irradiated to the floors 16*za*.

In the electric connectors illustrated in FIGS. 10 and 11, the inclining sidewalls 16*y* and 16*z* are designed to be entirely step-shaped. It should be noted that the inclining sidewalls 16*y* and 16*z* may be designed to be partially step-shaped, in which case, the remainder of the inclining sidewalls 16*y* and 16*z* remain flat.

In the inclining sidewalls 16*y* and 16*z*, the steps are designed to have a common height to thereby continuously form raised and recessed area. As an alternative, only raised areas may be formed entirely over the inclining sidewall.

INDUSTRIAL APPLICABILITY

The electric connector in accordance with the present invention can be used in fields of electronic/electric device industry and automobile industry, as an electric connector suitable for electronic and electric devices or an electric connector suitable for an electric circuit to be equipped in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2011-269185 filed on Dec. 8, 2011 including specification, claims, drawings and summary is incorporated herein by reference in its entirety.

What is claimed is:

1. An electric connector comprising:

a housing having an opening and a bottom, said housing being formed at said bottom with a recess having an inclining sidewall, which is inclined at an angle of about 45 degrees;

at least one electric terminal projecting through a bottom of said recess into said housing; and a seal composed of light-curing resin, said seal at least partially filling said recess therewith for hermetically sealing said electric terminal.

2. The electric connector as set forth in claim 1, wherein said inclining sidewall has a flat surface.

3. The electric connector as set forth in claim 1, wherein at least a part of a surface of said recess is a projecting curved surface.

4. The electric connector as set forth in claim 1, wherein said projecting curved surface has such a shape that a vertically irradiated light beam does not make shade therebelow.

5. The electric connector as set forth in claim 1, wherein at least a part of a surface of said recess is step-shaped.

6. The electric connector as set forth in claim 5, wherein each of steps has an inclining sidewall.

7. The electric connector as set forth in claim 1, wherein said recess has an area smaller than an area of said bottom of said housing when viewed vertically.

8. A housing defining a part of an electric connector, said housing having an opening and a bottom and being formed at said bottom with a recess having an inclining sidewall, which is inclined at an angle of about 45 degrees, said recess being formed at a bottom thereof with at least one hole through which an electric terminal is inserted such that said electric terminal projects into said housing, said recess being to be at least partially filled with light-curing resin for hermetically sealing said electric terminal.

9. The housing as set forth in claim 8, wherein said inclining sidewall has a flat surface.

10. The housing as set forth in claim 8, wherein at least a part of a surface of said recess is a projecting curved surface.

11. The housing as set forth in claim 8, wherein said projecting curved surface has such a shape that a vertically irradiated light beam does not make shade therebelow.

12. The housing as set forth in claim 8, wherein at least a part of a surface of said recess is step-shaped.

13. The housing as set forth in claim 12, wherein each of steps has an inclining sidewall.

14. The housing as set forth in claim 8, wherein said recess has an area smaller than an area of said bottom of said housing when viewed vertically.

* * * * *